US005130220A

United States Patent [19]

Nakamura et al.

[11] Patent Number: 5,130,220

[45] Date of Patent: Jul. 14, 1992

[54] PROCESS FOR PREPARING TONER BY SUSPENSION POLYMERIZATION AND TONER PREPARED THEREBY

[75] Inventors: Tatsuya Nakamura, Tokyo; Reiko Morimoto; Hiromi Mori, both of Yokohama, all of Japan

[73] Assignee: Canon Kabushiki Kaisha, Tokyo, Japan

[21] Appl. No.: 457,882

[22] Filed: Dec. 27, 1989

[30] Foreign Application Priority Data

Dec. 29, 1988 [JP] Japan ..... 63-335147

[51] Int. Cl.[5] ..... G03G 9/00; G03G 5/00; G03G 9/10

[52] U.S. Cl. ..... 430/109; 430/107; 430/111; 430/137

[58] Field of Search ..... 430/109, 137, 107

[56] References Cited

U.S. PATENT DOCUMENTS 4,071,670 1/1978 Vanzo et al. ..... 526/88
4,077,804 3/1978 Vanzo ..... 96/1 SD
4,148,741 4/1979 Bayley ..... 430/137
4,241,159 12/1980 Priem et al. ..... 430/137 X
4,314,931 2/1982 Hoffend et al. ..... 430/137
4,855,209 8/1989 Martin et al. ..... 430/126
4,912,010 3/1990 Mori et al. ..... 430/157

OTHER PUBLICATIONS

R. A. Nelson, Xerox Disclosure Journal, vol. 4, No. 6, 1979, p. 825.

*Primary Examiner*—Marion E. McCamish
*Assistant Examiner*—S. Crossan
*Attorney, Agent, or Firm*—Fitzpatrick, Cella, Harper & Scinto

[57] ABSTRACT

A toner is provided which is prepared by suspension polymerization of polymerizable monomer composition containing a chromatic dye or a chromatic pigment of which radical-active sites to inhibit the polymerization have been inactivated in the previously conducted bulk polymerization. The toner has superior developing characteristics and an anti-blocking property as well as superior color tone and excellent chroma.

24 Claims, No Drawings

PROCESS FOR PREPARING TONER BY SUSPENSION POLYMERIZATION AND TONER PREPARED THEREBY

BACKGROUND OF THE INVENTION

1. Field of the Invention

The present invention relates to a process of suspension polymerization for preparing a toner which is used for developing an electric latent image in an image-forming method such as electrophotography and electrostatic photography.

The present invention also relates to a toner prepared by the above-mentioned process.

2. Related Background Art

Toners are used for developing electric latent images or magnetic latent images in various image forming and recording processes.

Electrophotography, which is one of image forming processes, includes various methods such as shown in U.S. Pat. No. 2,297,691. In the electrophotography, a reproduced copy is prepared by forming an electric latent image generally with a photoconductive material; developing the latent image with a toner to form a toner image; optionally transferring the toner image onto an image-receiving material such as paper; and fixing the toner image on the image-receiving material or the like. Various methods are proposed for image development with a toner, and toner image fixation. Images are formed by methods suitable for respective image forming processes.

The toners used for these purposes are prepared generally by melt-blending a thermoplastic resin and a coloring material comprising a dye and/or a pigment to disperse the coloring material uniformly in the thermoplastic resin, and subsequently cooling, pulverizing, and classifying the mixture in a form of desired particle size.

This preparation process (pulverization process) has some limitations, such as in the range of selection of toner materials, even though the process gives toners of considerably high quality. For example, the dispersion of a coloring material in a resin should be sufficiently brittle to be pulverizable with an economically available pulverizing machine. Adjusting the required bittleness of the dispersion involves problems such that particles formed tend to have a broad particle size distribution, and that excessively fine particles are liable to be contained in the pulverized particles in a relatively large proportion. Moreover, such brittle material is subject to be further pulverized into fine powder in practical development use in image forming apparatuses such as copying machines.

In the pulverization method, fine solid particles such as a magnetic powdery material or a coloring powdery material cannot easily be dispersed uniformly in a resin. Since the degree of the dispersion of the fine solid particles relates to increase of fogging, and decrease of image density, sufficient care has to be paid to the degree of the dispersion. In some cases, a coloring material may be exposed at the broken section of a resin particle colored by a coloring material, causing variation of the developing characteristics of a toner.

To solve the problems involved in the toner prepared by pulverization method, manufacture of a toner by suspension polymerization is proposed in: Japanese Patent Publication No. 36-10231, British Patent No. 1583564, and U.S. Pat. Nos. 4,592,990 and 4,609,607. In this suspension polymerization, a polymerizable monomer and coloring material, (and additionally a polymerization initiator, a crosslinking agent, a charge controlling agent, and other additives as are necessary) are dissolved or dispersed uniformly to give a monomer composition, which is then dispersed in a continuous phase (e.g., an aqueous phase) containing a dispersion stabilizer by employing a suitable stirrer and is subjected to polymerization reaction to give a toner having a desired particle size.

In the preparation of a toner by suspension polymerization, a pigment or a dye is used as the coloring material. Since some coloring materials remarkably inhibit polymerization, applicable coloring materials are considerably limited in the suspension polymerization method, while in the pulverization method, polymerization-inhibiting coloring materials are applicable. In particular, dyes tend significantly to inhibit polymerization, so that it has been difficult to prepare by suspension polymerization a toner having a desired color and being excellent in development characteristics.

SUMMARY OF THE INVENTION

An object of the present invention is to provide a process for preparing a toner containing a chromatic dye or a chromatic pigment and having superior image-developing characteristics by suspension polymerization, and to provide a toner prepared by the process.

Another object of the present invention is to provide a process for preparing a toner superior in color tone by suspension polymerization, and to provide a toner prepared by the process.

Still another object of the present invention is to provide a toner having excellent chroma by suspension polymerization, and to provide a toner prepared by the process.

A further object of the present invention is to provide a process for preparing a toner by suspension polymerization in which inhibiting polymerization by a dye or a pigment is controlled and to provide a toner prepared by the process.

A still further object of the present invention is to provide a process for preparing a color toner having superior developing characteristics by suspension polymerization, and to provide a color toner prepared by the process.

According to an aspect of the present invention, there is provided a process for preparing a toner comprising: treating a chromatic dye or a chromatic pigment by bulk polymerization, dissolving or dispersing the treated dye or the pigment in a polymerizable monomer to prepare a solution or a dispersion in the polymerizable monomer, mixing a polymerization initiator with the solution or the dispersion in polymerizable monomer to prepare a monomer composition, dispersing the monomer composition in an aqueous dispersion medium to cause suspension polymerization to give a particulate polymer, and preparing toner from the resulting particulate polymer.

According to another aspect of the present invention, there is provided a toner prepared by a process comprising: subjecting a chromatic dye or a chromatic pigment to bulk polymerization, dissolving or dispersing the treated dye or the pigment in a polymerizable monomer to prepared a solution or a dispersion in the polymerizable monomer, mixing a polymerization initiator with the solution or the dispersion in polymerizable monomer to prepare a monomer composition, dispersing the monomer composition in an aqueous dispersion medium to cause suspension polymerization to give a particulate polymer, and preparing toner from the resulting particulate polymer.

DETAILED DESCRIPTION OF THE PREFERRED EMBODIMENTS

The properties of the toner, which is prepared from a polymerizable monomer by suspension polymerization, are greatly affected by the reaction state of the polymerizable monomer. For example, if the radicals generated from polymerization initiator are largely consumed by a dye or a pigment, the polymerization of the monomer is inhibited. Specifically, as shown in the comparative example below, the polymerization reaction did not proceed substantially in the suspension polymerization in the presence of a polymerization-inhibiting anthraquinone type dye (e.g., 1,4-diamino-2,3-diphenoxyanthraquinone).

If the suspension polymerization is practiced with a polymerization initiator in an amount of the total of the initiator consumed by the polymerization-inhibiting dye and that required for the polymerization, a large amount of low-molecular polymer is formed because of the presence of a large amount of polymerization initiator in the early stage of the polymerization. Consequently, the toner exhibits storage unstability (e.g., antiblocking property) or inferior image developing characteristics (e.g., durability after printing many sheets).

In the present invention, a chromatic dye (having chroma C* of 10 or more, preferably 30 or more, more preferably 40 or more) or a pigment (having chroma C* of 10 or more, preferably 30 or more, more preferably 40 or more) is treated by bulk polymerization to inactivate the radical-active sites of the dye or the pigment, and then the treated dye or pigment is dissolved in a polymerizable monomer to prepare a polymerizable monomer solution which is then subjected to suspension polymerization.

The treatment of the dye or the pigment is conducted by dissolving or dispersing the dye or the pigment in a polymerizable monomer, and subjecting the polymerizable monomer to bulk polymerization. In the bulk polymerization of the polymerizable monomer in the presence of a polymerization initiator, the radical-active sites of the dye or the pigment react with the polymerizable monomer to become inactive, and/or the radical-active sites of the dye or the pigment react mutually to become inactive in the bulk polymerization.

The dye or the pigment having been treated by the bulk polymerization does not inhibit substantially the polymerization initiated by a polymerization initiator in the preparation of toner by suspension polymerization, so that the suspension polymerization can be practiced satisfactorily. In the case where the polymerizable monomer used in the bulk polymerization is the same as the one in the suspension polymerization, the treated dye or pigment does not substantially inhibit the polymerization, and is dissolved or dispersed well in the polymerizable monomer, thus giving a satisfactory color tone and chroma of the resulting toner.

In the bulk polymerization treatment of a dye or a pigment, the concentration of the dye or the pigment is in the range of from 5 to 50% by weight, preferably from 10 to 20% by weight based on the polymerizable monomer. With the concentration of the dye or the pigment of 50% or higher, the bulk polymerization cannot effectively practiced, and the dye or the pigment having radical-active sites tends to remain in excess. With the concentration of the dye or the pigment of less than 5%, the amount of the polymer formed by bulk polymerization must necessarily be increased, which makes more difficult the uniform dissolution or dispersion of the polymerizable monomer, and lowers the coloring power of the polymerizable monomer.

The chromatic dyes or the chromatic pigments employed in the presented invention are preferably those which do not migrate into an aqueous phase, and exhibit little change in the color tone and the chroma in the bulk polymerization treatment. The examples thereof are anthraquinone dyes, xanthene (rhodamine) dyes, azine dyes, anthraquinone pigments, xanthene pigments, rhodamine pigments, and the like. In the present invention, the pigments do not include carbon black and magnetic materials.

The anthraquinone dyes are exemplified by Macrolex Red Violet R (condensate of 1,4-diamino-2,3-chloroanthraquinone with phenol) represented by the formula (1) below, and C.I. Solvent Red 52 (ring closure product of 1-(N-methylacetamido)-4-p-toluidinoanthraquinone to an anthrapyridone) represented by the formula (2) below.

(1)

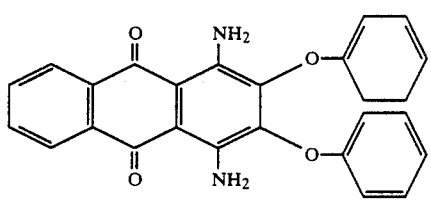

(2)

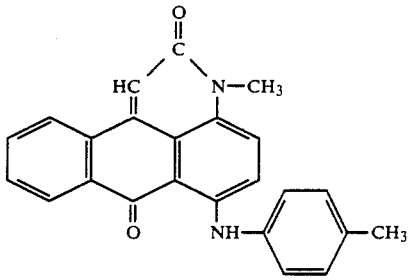

The xanthene dyes are exemplied by C.I. Solvent Red 49 (condensate of m-diethylaminophenol with phthalic anhydride) represented by the formula (3) below.

(3)

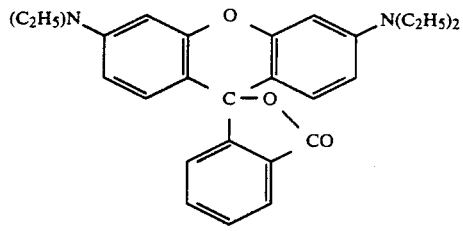

As anthraquinone pigments there is, for example, C.I. Pigment Red 83 (Sanyo Carmine L2B, manufactured by Sanyo Shikiso Co.).

The xanthene pigments include lake products derived from xanthene dyes represented by the formula (4). An example therefor as C.I. Pigment Red 81 (phosphotungstomolybdic acid salt of condensate of 3-ethylamino-p-cresol with phthalic anhydride).

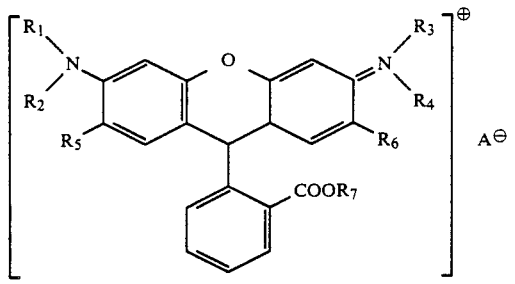

(4)

where $R_1$, $R_3$, $R_5$, $R_6$, and $R_7$ are the same or different and denote hydrogen or a lower alkyl; $R_2$ and $R_4$ may be the same or different and denote a lower alkyl; and A− denotes an anion.

The bulk polymerization for treating the dye or the pigment is preferably conducted by employing a polymerization initiator in an amount ranging from 0.01 to 10% by weight based on the total amount of the polymerizable monomer and the dye and/or the pigment, at a temperature of from 50° to 90° C. for a reaction time from 0.5 to 20 hours.

For initiating the bulk polymerization there are preferred azo type polymerization initiators as described below.

Vinyl monomers are preferable for the bulk polymerization. The examples of the vinyl monomers are styrene; styrene derivatives such as O-methylstyrene, m-methylstyrene, p-methylstyrene, p-methoxystyrene, p-ethylstyrene, etc; α-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, etc.; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, etc.; acrylic acid derivatives and methacrylic acid derivatives such as acrylonitrile, acrylamide, and so on. These monomers may be used singly or in combination.

The polymerizable monomer employed in the bulk polymerization should preferably be the same as the polymerizable monomer employed in the suspension polymerization as the post-treatment in view of the solubility or dispersibility of the dye or the pigment in the polymerizable monomer. If the dye or the pigment to be employed is insoluble in the polymerizable monomer in the bulk polymerization, the the dye or the pigment should preferably be agitated sufficiently with the polymerizable monomer by means of an agitation having a function of pulverizing, such as a ball mill, into a fine particulate form to be uniformly dispersed in the polymerizable monomer before the bulk polymerization.

The mass of the polymer prepared by the bulk polymerization and containing the dye or the pigment is preferably pulverized before the subsequent treatment.

The dye or the pigment having been treated by the bulk polymerization is dissolved or dispersed, together with the polymer formed in the bulk polymerization, in the polymerizable monomer to be employed in the suspension polymerization. It is desirable that the polymer formed by the bulk polymerization is sufficiently soluble in the polymerizable monomer in view of the solubility or dispersibility of the dye or the pigment. Accordingly as mentioned above, the polymerizable monomers employed in the bulk polymerization are preferably identical or analogous with that employed in the suspension polymerization. For example, if styrene is used as the polymerizable monomer in the suspension polymerization, styrene or a mixture of styrene with an acrylic (or methacrylic) ester is preferably used as a polymerizable monomer in the bulk polymerization. If styrene and an acrylic (or methacrylic) ester are used in the suspension polymerization, styrene or acrylic (or methacrylic) ester is preferably used in the bulk polymerization.

The treated dye or pigment is used in the suspension polymerization in an amount of from 0.5 to 10% by weight based on the polymerizable monomer in the suspension polymerization.

The polymerizable monomer used in the suspension polymerization is preferably a vinyl monomer. The examples of the vinyl monomers are styrene; styrene derivatives such as o-methylstyrene, m-methylstyrene, p-methylstyrene, p-methoxystyrene, p-ethylstyrene, etc; α-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, etc.; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, etc.; acrylic acid derivatives and methacrylic acid derivatives such as acrylonitrile, methacrylonitrile, acrylamide, and so on. These monomers may be used singly or in combination. Among the above-mentioned monomers, styrene or a styrene derivative, or a combination thereof with another monomer is preferably used as the polymerizable monomer in view of the image development characteristics and the durability of the toner.

As as additive, a vinyl type polymer or copolymer having a polar group, or a cyclized rubber is preferably added in suspension polymerization of the polymerizable monomer. The vinyl polymer copolymer having a polar group has preferably a weight-average molecular weight of from 10,000 to 200,000, preferably from 30,000 to 100,000.

In the present invention, the polymerizable monomer composition containing the vinyl polymer or copolymer having a polar group or the cyclized rubber is preferably suspended and polymerized in an aqueous phase containing a dispersion stabilizer which is chargeable oppositely to the polarity of the polar group-containing polymer or copolymer.

The cationic or anionic polymer or the cationic or anionic copolymer or the cyclized rubber in the polymerizable monomer composition exerts electrostatic attracting force with the oppositely chargeable anionic or cationic dispersion stabilizer mutually on the surface of the particles to be formed into a toner, whereby the dispersion stabilizer covers the particle surface to prevent coalescing of the particles and to stabilize the suspension. Further, the polar-group-containing polymer or copolymer added in the polymerization migrates to the surface of the particles to form a kind of a shell, thus the resulting particles are in a form of pseudo-capsules. The use of a relatively high molecular weight of the polar-group-containing polymer or copolymer or the cyclized rubber gives an excellent anti-blocking property, development characteristics, and wearing property to the toner particles, while in the inner portion of the particles, polymerization is effected to form a relatively low molecular weight polymer so as to contribute the improvement of fixing characteristics. Thus a toner can be prepared which satisfies the conflicting requirements of fixing properties and anti-blocking properties.

The examples of the polar-group-containing polymer (including copolymer), and the oppositely charging dispersion stabilizer are shown below.

(i) The cationic polymers include those derived from nitrogen-containing monomers such as dimethylaminoethyl methacrylate, diethylaminoethyl acrylate, etc. and copolymers derived from styrene or a unsaturated carboxylic ester with the nitrogen containing monomer.

(ii) The anionic polymers include those derived from nitrile type monomers such as acrylonitrile etc.; halogen-containing monomers such as vinyl chloride, etc.; unsaturated carboxylic acids such as acrylic acid, etc.; unsaturated dibasic acids; anhydrides of unsaturated dibasic acids; and nitro-type monomers.

(iii) The anionic dispersion stabilizer includes colloidal silica such as Aerosil #200, #300, and #380 (made by Nippon Aerosil K. K.).

(iv) The cationic dispersion stabilizers include aluminum oxide, and positive-charging hydrophilic fine powdery silica such as aminoalkyl-modified colloidal silica, etc.

A cyclized rubber may be used in place of the polar-group-containing polymer.

The dispersion stabilizer is preferably added to the aqueous medium in an amount of from 0.2 to 20 parts by weight, more preferably from 0.3 to 15 parts by weight relative to 100 parts by weight of the polymerizable monomer.

The charge-controlling agent optionally added may be a known agent such as a metal complex of salicylic acid and a metal complex of dialkylsalicylic acid. The charge-controlling agent is added in an amount of from 0.1 to 5% by weight based on the toner.

For the purpose of improving the releasing property at hot roll fixing, a hydrocarbon compound or a wax which is used generally as a release agent may be added to the toner. The hydrocarbon compounds used in the present invention are preferably paraffin wax having a softening point within the range of from 55° to 75° C. More specifically, the hydrocarbon compounds include Paraffin Wax (made by Nippon Oil Co., Ltd.), Paraffin Wax (made by Nippon Seiko Co., Ltd.), Microwax (made by Nippon Oil Co., Ltd.), Microcrystalline Wax (made by Nippon Seiko Co., Ltd.), etc.

The polymerization initiators for polymerizing the polymerizable monomer include azo type initiators such as 2,2'-azobisisobutyronitrile, 2,2'-azobis(2,4-dimethylvaleronitrile), (1-phenylethyl)azodiphenylmethane, and dimethyl 2,2'-azobisisobutanate. The polymerization initiator is used generally in an amount of from 0.5 to 10% by weight based on the polymerizable monomer.

The suspension polymerization may be practiced in the presence of a crosslinking agent to form a crosslinked polymer. The examples of the crosslinking agent are divinylbenzene, divinylnaphthalene, divinyl ether, divinyl sulfone, diethyleneglycol dimethacrylate, triethylenglycol dimethacrylate, ethyleneglycol dimethacrylate, polyethyleneglycol dimethacrylate, diethyleneglycol diacrylate, triethyleneglycol diacrylate, 1,3-butyleneglycol diemethacrylate, 1,6-hexaneglycol dimethacrylate, neopentylglycol dimethacrylate, dipropyleneglycol dimethacrylate, polypropyleneglycol dimethacrylate, 2,2'-bis(4-methacryloxydiethoxyphenyl)propane, 2,2'-bis(4-acryloxydiethoxyphenyl)propane, triemethylolpropane, trimethacrylate, trimethylolpropane triacrylate, tetramethylolmethane tetraacrylate, dibromonoeopentylglycol dimethacrylate, diallyl phthalate, etc.

An excessive amount used of the crosslinking agent makes the toner less fusible, resulting in inferior heat-fixation characteristics, while insufficient amount used of the crosslinking agent impairs the properties such as an anti-blocking property and durability which are necessary for the toner, causing a part of the toner to adhere incompletely to the paper at hot-roller fixing, so that an offset phenomena occurs such that the toner adheres to the roller face and transferred onto the succeeding paper cannot easily be prevented. Accordingly, the crosslinking agent is preferably used in an amount of from 0.001% to 15%, more preferably from 0.1% to 10% by weight of the total monomer.

The toner of the present invention is prepared in the manner described below.

A dye or a pigment having been treated by bulk polymerization, a crosslinking agent, a polymerization initiator, and other additives are added to a polymerizable monomer. The monomer system, having been dissolved or dispersed uniformly by a dispersing machine such as an ultrasonic dispersing machine and a homogenizer, is dispersed in an aqueous phase (namely, a continuous phase) containing a suspension stabilizer by means of an ordinary stirrer having agitating blades, or a high-shear agitator such as a homomixer and a homogenizer. In the suspension polymerization, usually the water is used in an amount of from 300 parts to 3000 parts by weight relative to 100 parts by weight of the monomer composition. The intensity and the time of stirring are initially adjusted so that the monomer composition is in the desired toner particle size: generally, 30 μm or less, preferably a volume-average particle diameter of from 3 to 15 μm, and thereafter stirring is adjusted so as to maintain the above state by the action of the dispersion stabilizer and to prevent sedimentation of the particles. The polymerization is conducted at a temperature not lower than 40° C., generally from 50° to 90° C. After completion of the reaction, the formed particulate toner is washed, recovered by filtration, and dried. A fluidity improving agent may be mixed to the particulate toner (external addition). The fluidity improvement agent may be colloidal silica, a fatty acid metal salts, fine powdery Teflon brand tetrafluoroethylene, or the like.

The present invention is more specifically described referring to Examples.

EXAMPLE 1

Treatment of dye

| | |
|---|---|
| Styrene | 30 parts by weight |
| 2-Ethylhexyl acrylate | 5 parts by weight |
| Anthraquinone type magenta dye (Red Violet R, made by Bayer Co.) | 5 parts by weight |

The above formulation components were heated to 60° C. in a vessel. Therein 2 parts by weight of an initiator (2,2'-azobis(2,4-dimethylvalero)niitrile; V-65 made by Wako Junyaku K.K.) was dissolved. The solution was kept at 60° C. for 10 hours to cause and complete the bulk polymerization, giving a mass of a copolymer of styrene with 2-ethylhexyl acrylate containing the anthraquinone type magenta dye which has been blocked from polymerization inhibiting property. The resulting mass was pulverized to give a copolymer powder containing the treated dye.

Preparation of toner

To 1200 parts by weight fo deionized water, 0.5 parts by weight of γ-aminopropyltrimethoxysilane was added, and thereto 10 parts by weight of Aerosil 200 made by Nippon Aerosil K.K.) was added. The mixture was heated to 70° C., and was treated with a TK Homomixer: Type M (made by Tokushu Kika Kogyo K.K.) at 10,000 rpm for 15 minutes for dispersion. Further thereto 1/10N hydrochloric acid was added to bring the aqueous dispersion medium to pH 6. The colloidal sillica exhibited a property of positively electrifying due to the act of γ-aminopropyltrimethoxysilane.

| | |
|---|---|
| Styrene | 153 parts by weight |
| 2-ethylhexyl acrylate | 12 parts by weight |
| Paraffin Wax T-550 (made by Taišei Kosan K.K.) | 32 parts by weight |
| Styrene/methacrylic acid copolymer (copolymerization ratio: 90:10, weight-average molecular weight: about 50,000) | 10 parts by weight |
| Copolymer powder containing treated dye | 40 parts by weight |

The above components were heated to 70° C. in a vessel to dissolve the copolymer powder and to prepare a monomer mixture. Further therein, at the temperature of 70° C., 10 parts by weight of polymerization initiator (dimethyl 2,2'-azobisisobutyrate; V-601 made by Wako Junyaku K.K.) was dissolved to prepare a monomer composition.

The monomer composition was put into a 2-liter flask containing the above prepared aqueous dispersion medium, which was agitated under nitrogen atmosphere at 70° C. for 60 minutes at 7000 rpm by means of a TK homomixer to suspend the monomer composition in a form of particles. Further polymerization was continued at 70° C. for 10 hours by stirring with a paddle-blade stirrer. After completion of the polymerization, the reaction product was cooled, and thereto sodium hydroxide was added to dissolve the dispersing agent. A toner was prepared therefrom by filtration, water-washing and drying.

The resulting toner had a sharp distribution of the particle size with a volume-average diameter of 11.8 μm as measured by Coulter Counter, Type TA-II (aperture diameter: 100 μmm). The quantity of frictional electrification of the toner employing iron powder (200/300 mesh) was −22.4 μc/g according to a blow-off method. 0.8 parts by weight of a hydrophobic colloidal silica (Tullanox 500, made by Tulco Inc.) was mixed with 100 parts by weight of the toner. 8 parts by weight of the particulate toner having the hydrophobic colloidal silica on the surface was mixed with 92 parts by weight of an acrylic-resin-coated ferrite carrier to give a developing agent.

The resulting developing agent was employed in successive 20,000 sheets of image printing by means of a color laser copying machine, CLC-1 (made by Canon K.K). As the result, the copy was sharp without fogging, and exhibited satisfactory magenta color with excellent reflection spectrum characteristics.

A toner image was transferred onto a light-transmissive plastic sheet for overhead projector, and fixed thereon. It was found that the formed toner image on the sheet was satisfactory in color tone and light-transmissivity.

The toner, after left standing in an environment at a temperature of 50° C. for one day, did not substantially form a coagulated matter, thus the toner of Example 1 having a satisfactory anti-blocking property.

EXAMPLE 2

A bulk polymerization reaction and a suspension polymerization reaction were conducted to prepare a toner in the same manner as in Example 1 except tha an anthraquinone type magenta dye (Red 3005, made by Sumitomo Chemical Co., Ltd.) was used as the polymerization-inhibiting dye.

The toner had a sharp particle size distribution with a volume-average diameter of 10.9 μm as measured by Coulter Counter (aperture diameter: 100 μm). The quantity of frictional electrification of the toner employing iron powder (200/300 mesh) was −20.5 μc/g according to a blow-off method. 0.8 parts by weight of a hydrophobic coloidal silica (Tullanox 500, made by Tulco Inc.) was mixed with 100 parts by weight of the toner. 8 parts by weight of the particulate toner having the hydrophobic colloidal silica on the surface was mixed with 92 parts by weight of an acrylic-resin-coated ferrite carrier to give a developing agent.

The resulting developing agent was employed in successive 20,000 sheets of image printing by means of a color laser copying machine, CLC-1 (made by Canon K.K). As the result, the copy was sharp without fogging, and exhibited satisfactory magenta color with excellent reflection spectrum characteristics.

A toner image formed on a light-transmissive plastic sheet was satisfactory in color tone and light-transmissivity.

The resulting toner had a satisfactory anti-blocking property even at a high temperature.

EXAMPLE 3

A bulk polymerization reaction and a suspension polymerization reaction were conducted to prepare a toner in the same manner as in Example 1 except that a xanthene type (rhodamine type) magenta pigment (C.I. Pigment Red 81) was used as the polymerization-inhibiting pigment in place of the dye.

The toner had a sharp particle size distribution with volume-average diameter of 11.2 μm as measured by Coulter Counter (aperture diameter: 100 μm). The quantity of frictional electrification of the toner employing iron powder (200/300 mesh) was −18.9 μc/g according to a blow-off method. By employing the resulting toner, a developing agent was prepared in the same manner as in Example 1.

The resulting developing agent was employed in successive 20,000 sheets of image printing by means of a color laser copying machine, CLC-1 (made by Canon K.K). As the result, the copy was sharp without fogging, and exhibited satisfactory magenta color with excellent reflection spectrum characteristics.

A toner image formed on a light-transmissive plastic sheet was satisfactory in color tone and light-transmissivity.

The resulting toner had a satisfactory anti-blocking property even at a high temperature.

COMPARATIVE EXAMPLE 1

Preparation of toner

To 1200 parts by weight of deionized water was added 0.5 parts by weight of γ-aminopropyltrimethoxysilane, and thereto 10 parts by weight of Aerosil 200 (made by Nippon Aerosil K.K) was added. The mixture was heated to 70° C., and was treated with a TK Homomixer: Type M (made by Tokushu Kika Kogyo K.K.) at 10,000 rpm for 15 minutes for dispersion. Further thereto 1/10N hydrochloric acid was added to bring the aqueous dispersion medium to pH 6.

| | |
|---|---|
| Styrene | 183 parts by weight |
| 2-ethylhexyl acrylate | 17 parts by weight |
| Paraffin Wax T-550 (made by Taisei Kosan K.K.) | 32 parts by weight |
| Styrene/methacrylic acid copolymer (copolymerization ratio: 90:10, weight-average molecular weight: about 50,000) | 10 parts by weight |
| Anthraquinone type magenta dye (Red Violet R, made by Bayer Co.) | 5 parts by weight |

The above components were heated to 70° C. in a vessel to dissolve the dye and to prepare a monomer mixture. Further thereto, at the temperature of 70° C. maintained, 10 parts by weight of polymerization initiator (V-601 made by Wako Junyaku K.K.) was added and dissolved to prepare a monomer composition.

The monomer composition was put into a 2-liter flask containing the above prepared aqueous dispersion medium, which was agitated under nitrogen atmosphere at 70° C. for 60 minutes at 7000 rpm by means of a TK homomixer to suspend the monomer composition in a form of particles. Further the mixture was stirred at 70° C. with a paddle-blade stirrer. However, the polymerization did not proceed satisfactory, giving no particulate polymer which can be used as a solid particulate toner.

COMPARATIVE EXAMPLE 2

The same operation was conducted as in Comparative example 1 except that Red 3005 (made by Sumitomo Chemical Co., Ltd.) was used as the dye. However, the polymerization did not proceed satisfactory, giving no particulate polymer which can be used as a solid particulate toner.

COMPARATIVE EXAMPLE 3

The same operation was conducted as in Comparative example 1 except that a pigment, C.I. Pigment Red 81 was used in place of the dye. However, the polymerization did not proceed satisfactory, giving no particulate polymer which can be used as a solid particulate toner.

EXAMPLE 4

The bulk polymerization and the suspension polymerization were conducted in the same manner as in Example 1 to prepare a toner, except that a polymerization-inhibiting anthraquinone type pigment (C.I. Pigment Red 83, Sanyo Carmine L2B, manufactured by Sanyo Shikiso Co.) was used in place of the dye. The resulting toner had superior developing characteristics and anti-blocking property.

EXAMPLE 5

The bulk polymerization and the suspension polymerization were conducted in the same maner as in Example 1 to prepare a toner, except that the polymerization-inhibiting xanthene type (rhodamine type) dye (C.I. Basic Red 1, Rhodamine F5G, manufactured by BASF) was used. The resulting toner has superior developing characteristics and anti-blocking property.

As described above, the process of the present invention has made it feasible to prepare a toner with a chromatic dye or a chromatic organic pigment which can not give a toner by suspension polymerization because of the polymerization-inhibiting property thereof, and gives a toner having desired color tone and chroma in an easy manner by suspension polymerization.

We claim:

1. A process for preparing a color toner having enhanced releasability for hot roll fixing comprising:

(a) treating a chromatic dye or a chromatic pigment by bulk polymerization of a polymerizable monomer;

(b) dissolving or dispersing the treated dye or the treated pigment in a mixture of the polymerizable monomer, paraffin wax and polar polymer or cyclized rubber to prepare a solution or a dispersion containing the treated dye or the treated pigment, the polymerizable monomer, the paraffin wax and the polar polymer or cyclized rubber;

(c) mixing a polymerization initiator with the solution or the dispersion to prepare a monomer composition;

(d) dispersing the monomer composition in an aqueous dispersion medium to cause suspension polymerization to give a particulate polymer; and (e) making a color toner from the resulting particulate polymer.

2. A process according to claim 1, wherein the dye is dissolved in a polymerizable monomer to form a solution, and the solution of the dye in the polymerizable monomer is subjected to bulk polymerization for treatment of the dye.

3. A process according to claim 2, wherein the dye is dissolved in a vinyl type monomer, and is treated by bulk polymerization in the presence of a polymerization initiator.

4. A process according to claim 3, wherein the vinyl type monomer is selected from the group consisting of styrene, styrene derivatives, α-methylene aliphatic carboxylic esters, α-methylene aliphatic carboxylic acids, acrylic esters, and acrylic acid, and the polymerization initiator is an azo type initiator or a peracid.

5. A process according to claim 3, wherein the vinyl type monomer is selected from the group of styrene, methacrylic esters, and acrylic esters, and the polymerization initiator is an azo type initiator.

6. A process according to claim 1, wherein the dye has a polymerization-inhibiting property, and the polymerization-inhibiting property is masked by bulk polymerization.

7. A process according to claim 1, wherein the dye is a coloring material selected from the group consisting of anthraquinone type dyes, xanthene type dyes, and azine type dyes.

8. A process according to claim 1, wherein the dye is dissolved in the polymerizable monomer in an amount of from 5 to 50% by weight relative to the polymerizable monomer, and the polymerizable monomer containing the dissolved dye is polymerized by bulk polymerization in the presence of the initiator at the temperature of from 50° C. to 90° C. for from 0.5 to 20 hours whereby the dye is treated.

9. A process according to claim 8, wherein the dye is a coloring material selected from the group of anthraquinone type dyes, xanthene type dyes, and azine type dyes; the polymerizable monomer is a vinyl type monomer selected from the group consisting of styrene, acrylic esters, methacrylic esters and the mixtures thereof; and the polymerization initiator is an azo type polymerization initiator.

10. A process according to claim 1, wherein the dye is dissolved in a polymerizable monomer to form a solution; the solution of the dye in the polymerizable monomer is subjected to bulk polymerization to prepare a mass of a vinyl type polymer containing the treated dye; the mass is pulverized to prepare a powder of the vinyl type polymer containing the treated dye; the powder is dissolved in a vinyl type monomer to prepare a vinyl type monomer solution; the vinyl type monomer solution is mixed with a polymerization initiator to prepare a vinyl type monomer composition; and the vinyl typemonomer composition is dispersed in an aqueous dispersion medium and is subjected to suspension polymerization.

11. A process according to claim 1, wherein the dye is a coloring material selected from the group consisting of anthraquinone type dyes, xanthene type dyes, and azine type dyes; the vinyl type monomer employed in the bulk polymerization is a monomer selected from the group consisting of styrene, acrylic esters, methacrylic esters, and mixtures thereof; the polymerization initiator employed in the bulk polymerization is an azo type initiator; the vinyl type monomer employed in the suspension polymerization is a monomer selected from the group consisting of styrene, acrylic esters, methacrylic esters, and mixtures thereof; and the polymerization initiator employed in the suspension polymerization is an azo type initiator.

12. A process according to claim 10, wherein the vinyl type monomer composition contains the treated dye in an amount of from 0.5% to 10% by weight based on the vinyl type monomer.

13. A process according to claim 10, wherein the polymerization initiator is employed in an amount of from 0.01% to 10% by weight based on the solution of the vinyl type monomer containing the dissolved dye, and the initiator in the suspension polymerization is employed in an amount of from 0.5% to 10% by weight based on the vinyl type monomer.

14. A process according to claim 10, wherein the vinyl type monomer composition contains a polar polymer or a cyclized rubber.

15. A process according to claim 14, wherein the polar polymer has a weight-average molecular weight of from 10,000 to 200,000.

16. A process according to claim 10, wherein the polar polymer has a weight-average molecular weight of from 30,000 to 100,000.

17. A process according to claim 10, wherein the vinyl type monomer composition contains an anionic polar polymer or a cyclized rubber, and the aqueous dispersion medium contains a cationic dispersion stabilizer.

18. A process according to claim 10, wherein the vinyl type monomer composition contains a cationic polar polymer, and the aqueous dispersion medium contains an anionic dispersion stabilizer.

19. A process according to claim 10, wherein the vinyl type monomer composition is polymerized at a temperature of not less than 40° C. by suspension polymerization.

20. A process according to claim 10, wherein the vinyl type monomer composition is polymerized at a temperature of from 50° C. to 90° C. by suspension polymerization.

21. A process according to claim 1, wherein the pigment comprises an anthraquinone type pigment or a xanthene type pigment.

22. A process according to claim 21, wherein the anthraquinone type pigment has a polymerization-inhibiting property.

23. A process according to claim 21, wherein the xanthene type pigment has a polymerization-inhibiting property.

24. A toner prepared by a process according to any one of claims 1 to 23.

* * * * *